United States Patent [19]

Garner

[11] Patent Number: 4,940,956

[45] Date of Patent: Jul. 10, 1990

[54] BAND-PASS FILTER AND SUPPORT STRUCTURE THEREFOR

[75] Inventor: William J. Garner, Yardley, Pa.

[73] Assignee: International Mobile Machines Corporation, Philadelphia, Pa.

[21] Appl. No.: 247,381

[22] Filed: Sep. 21, 1988

[51] Int. Cl.[5] ..... H01P 1/207

[52] U.S. Cl. ..... 333/209; 333/227; 333/232

[58] Field of Search ..... 333/227, 231, 232, 235, 333/208, 209

[56] References Cited

U.S. PATENT DOCUMENTS

| | | | |
|---|---|---|---|
| 2,263,184 | 11/1941 | Mouromtseff et al. | 333/231 X |
| 2,383,343 | 8/1945 | Ryan | 333/231 X |
| 2,553,811 | 5/1951 | Carnine et al. | 333/234 |
| 4,035,749 | 7/1977 | Slocum et al. | 333/232 |
| 4,243,961 | 1/1981 | Faillon et al. | 333/209 X |
| 4,644,303 | 2/1987 | Jachowski et al. | 333/229 X |
| 4,736,173 | 4/1988 | Basil, Jr. et al. | 333/229 |

*Primary Examiner*—Eugene R. LaRoche
*Assistant Examiner*—Benny Lee
*Attorney, Agent, or Firm*—Arthur A. Jacobs

[57] ABSTRACT

A band pass-band reject filter in which the filter housing which comprises the resonant cavity is contained within an annular wall that is supported at each end by an end plate. The filter is connected to an instrument rack or the like by the distal ends of bolts which extend between the end plates and which lie closely along side the annular wall. The end plates are soldered to the annular housing. The bolt heads are soldered to the end plate and their shafts are soldered to the side wall.

11 Claims, 2 Drawing Sheets

BAND-PASS FILTER AND SUPPORT STRUCTURE THEREFOR

BACKGROUND OF THE INVENTION

1. Field Of the Invention

This invention relates to a filter and more particularly to a support for the resonant cavity of a band pass-band reject filter.

Band pass-band reject filters are well-known filters which are used to limit the frequencies which are available to a circuit. Typically, they comprise tuning elements so that the particular pass and reject frequencies can be varied.

The filter elements may be contained in a housing which comprises a resonant cavity for the filter. Usually the filter or a plurality of filters are supported by a plate which is mounted on an instrument rack or the like. Typical filters are manufactured by Wacom Products, Inc. of Waco, Tex., and Celware of Marlboro, N.J. The Wacom filter is described in U.S. Pat. No. 4,080,601 to Alcorn.

Band pass-band reject filters must be carefully adjusted and aligned to exhibit the desired characteristics. Thus, if they are struck or dropped, then they can easily fall into disalignment. This is a problem during assembly and shipping. It also is a problem after the filters are mounted on an instrument rack since they can be jarred by personnel or by being struck by other devices which are being mounted or removed from the instrument rack.

With the foregoing in mind, it is desirable to have the resonant cavity of a band pass-band reject filter be of sufficient rigidity so that it will be able to resist the type of jarring and subsequent misalignments described above.

Preferably, the structure which accomplishes this result should be such that it can support more than one band pass-band reject filter.

SUMMARY OF THE INVENTION

Briefly, the invention relates to a band pass-band reject filter which comprises an annular wall and first and second end plates. One of the end plates is disposed at and in engagement with each of the ends of said annular wall. A plurality of elongated members are connected to and extend between the end plates with at least one of the elongated members lying alongside the outer wall in supporting relation to it. Means are provided on one of the end plates for tuning the circuit, and means are provided for connecting the filter to a support.

BRIEF DESCRIPTION OF THE DRAWING

The invention will be better understood and further advantages and uses thereof will be readily apparent when considered in view of the following detailed description of exemplary embodiments, taken with the accompanying drawing in which.

DESCRIPTION OF THE PREFERRED EMBODIMENT

Figure 1:
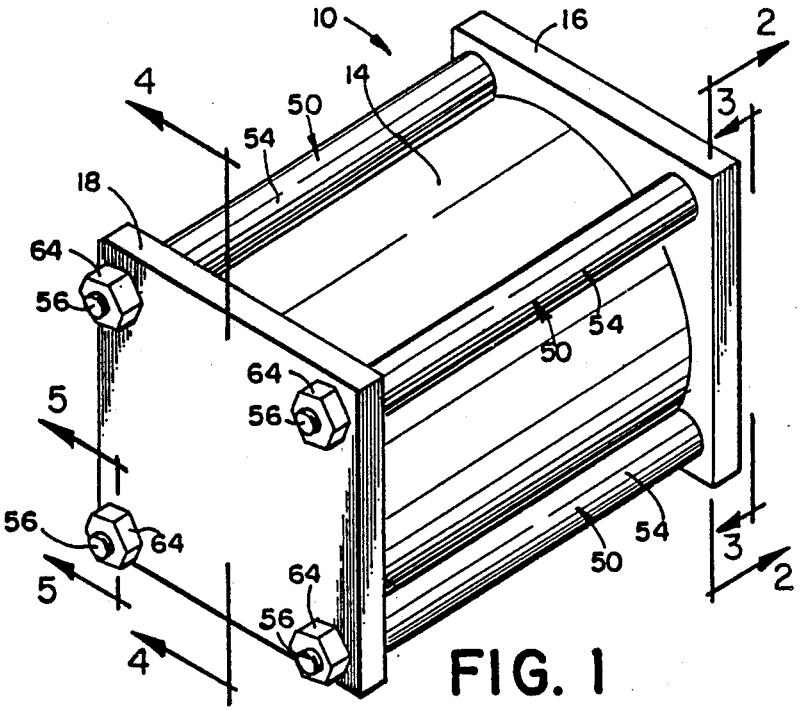
FIG. 1 is a top perspective view of a band passband reject filter constructed in accordance with a presently preferred embodiment of the invention.

Referring to FIG. 1, a band pass-band reject filter 10 including an elongated chamber which serves as a resonant cavity is constructed in accordance with a presently preferred form of the invention. The resonant cavity comprises annular wall 14 and first and second end plates 16 and 18.

Preferably, annular wall 14 and end plates 16 and 18 are comprised of copper, or aluminum which is plated with copper.

Figure 2:
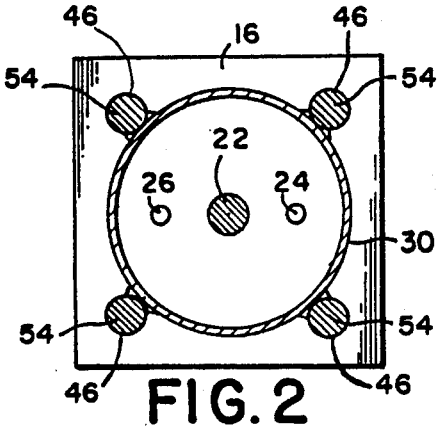
FIG. 2 is a section view taken along line 2—2 of FIG. 1.
Figure 3:
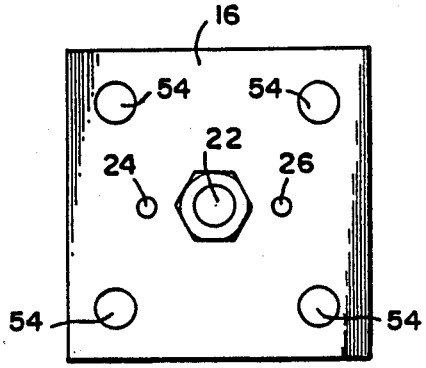
FIG. 3 is a section view taken along line 3—3 of FIG. 1.
Figure 4:
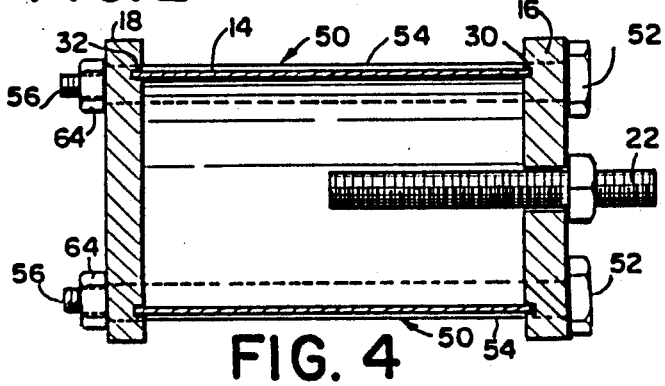
FIG. 4 is a section view taken along line 4—4 of FIG. 1.

As shown in FIGS. 2, 3 and 4 end plate 16 is provided with an aperture through which a tuning rod 22 extends. Further as shown in FIGS. 2 and 3, connectors 24 and 26 are also mounted on end plate 16. The manner in which these elements function form no part of this invention since their general operation is described in the Alcorn Patent. However, it should be understood that the filter resonant frequency is adjusted by axially moving the tuning rod 22 within the resonant cavity. Further, the filter can be connected to an RF loop or to another filter by connectors 24 and 26.

Also as shown in FIGS. 2 and 4 the first and second end plates 16 and 18 have on their facing surfaces annular grooves 30 and 32 in which the opposed ends of annular wall 14 of the resonant cavity are received. Preferably, the annular wall 14 is electrically and mechanically connected to each of the end plates 16 and 18 by a suitable solder.

As best seen in FIGS. 2 and 3, the end plate 16 is provided with a plurality of openings 44 of predetermined size. End plate 18 is provided with a plurality of openings 46. Openings 46 are slightly smaller than openings 44 for a reason which will become apparent below. As best seen in FIGS. 2 and 3 the openings 44 in end plate 18 are adjacent grooves 30 and 32 and are of sufficient size to accommodate the shafts of elongated threaded members such as bolts 50.

Bolts 50 extend between the end plates 16 and 18 as best seen in FIGS. 1 and 4. Each bolt 50 comprises a bolt head 52 (see FIG. 4) which may be hexagonal or square as desired and a shaft 54. The shaft 54 which is of a predetermined diameter fits within opening 44 in end plate 16.

Figure 5:
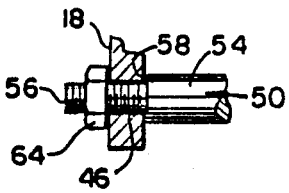
FIG. 5 is a section view taken along line 5—5 of FIG. 1.

As shown in FIG. 5, the distal end of each of bolts 50 has a threaded end portion 56 of reduced diameter which defines a ledge 58 at its juncture with shaft 54. The threaded end portions 56 are received in openings 46 and in end plate 18. But since opening 46 is smaller than the cross section of shaft 54 the end plate 18 is constrained by ledge 58 so that the annular wall 14 cannot be crushed between end plates 16 and 18.

Since the openings 44 and 46 in the end plates 16 and 18 are disposed around the grooves 30 and 32, when the bolts 50 are inserted in the openings 44 and 46, their shafts lie along the annular wall 14 of the resonant cavity.

Preferably, the bolts 50 are made from solid copper or steel with copper or silver plating.

The bolt heads 52 are soldered to the end plate 16 while their shafts are soldered to the annular wall 14. The bolt heads and shafts are connected to the end plate 16 and to the annular wall 14 in order to reinforce them and protect them against damage.

As best seen in FIG. 3, the threads on the reduced diameter portion 56 of the bolts 50 may receive suitable fasteners such as nuts 64.

Preferably, the nuts 64 are made from the same material as the bolts. The nuts are threaded onto the reduced diameter portion and are readily removable from those portions.

Figure 6:
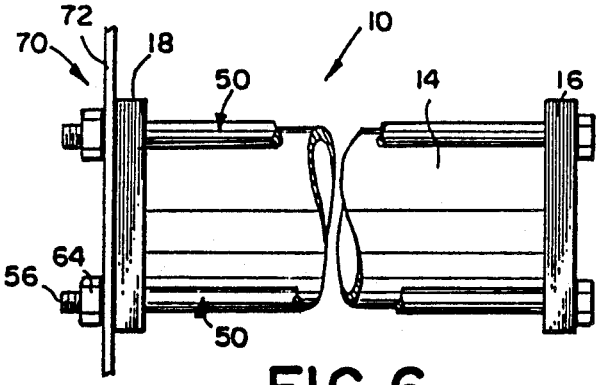
FIG. 6 is a side elevation view of the filter shown in FIG. 1 mounted on an instrument rack.

The structure just described can be advantageously used to mount the filter on an instrument rack 70 as best seen in FIG. 6. Thus, in FIG. 6 the nuts 64 have been removed from the threaded ends 56 of the bolts 50 so that the reduced diameter ends can be passed through suitable openings (not shown) in a plate 72 mounted on the instrument rack 70 with end plate 18 lying against plate 72 and end plate 16 being spaced from plate 72.

The nuts 64 are re-threaded onto the threaded end 56 of the bolts 50 which now extend through the openings in plate 72. To separate the filter 10 from the rack, nuts 64 are merely separated from their respective end portions and the bolts 50 removed from plate 72. The nuts can be re-threaded onto the threaded end portions for use at a later time.

Because of the use of the bolts 50 and the soldered connections between the annular wall 14 and the end plates 16 and 18, a rigid structure comprising the band pass-band reject filter has been created.

Further, as pointed out earlier, the arrangement of the interior parts of the filter which are critical to its operation will stay in the position in which they are placed without shifting or becoming misaligned.

Thus, the tuning shaft 22 which extends through the center of end plate 16 must be accurately and centrally positioned within the resonant cavity. If it is disposed to one side of the filter as might be the case if it were bent, or there should be any other misalignments, it is important that they be detected before the device is completely assembled.

The structure described and disclosed herein permits adjustments of the tuning shaft and any other components of the filter prior to its final assembly, and once that assembly is achieved, the permanent closing of the housing by the soldered connections between the end plates and the annular wall assure that they will not be moved. Further, the integrity of the structure is enhanced by virtue of the fact that the bolts which lie along side the housing and in contact with it are actually physically connected to it by the solder.

Figure 7:
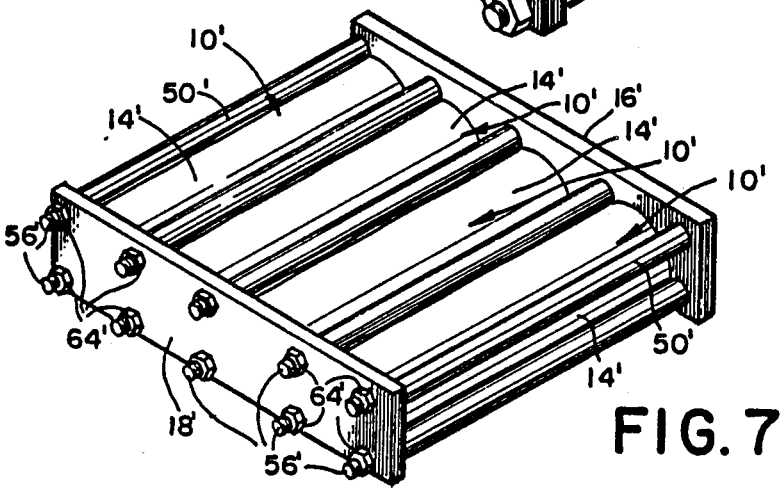
FIG. 7 is a perspective view of a plurality of filters arranged in a square array.

In FIG. 7 another embodiment of the invention is disclosed. In this embodiment, the advantages of the embodiment described in FIGS. 1–6 are incorporated into a structure which supports a plurality of band pass-band reject filters 10' in an horizontal array. The filters may be connected to each other or they may be in separate circuits.

In referring to the structure shown in FIG. 7, elements which are the same or similar to those described earlier will be referred to by the same reference numbers followed by a prime (').

In FIG. 7 two elongated rectangular end plates 16' and 18' are provided.

Each of the end plates 16' and 18' are provided with a plurality of horizontally spaced facing grooves (not shown) in which are received the ends of the annular walls 14' of the resonant cavities of the filters 10'.

The filters 10' are secured to the end plates 16' and 18' by being soldered thereto. Each of the housings 10' is further secured to the end plate by bolts 50' which are identical in structure to bolts 50 described above. As explained above, each bolt 50' extends through openings in end plates 16' and 18'. The bolts 50' lie along annular wall 14' and are soldered thereto. Their bolt heads (not shown) are soldered to end plate 16'. The threaded end portion 56' of each bolt 50' extends through an opening (not shown, but similar to opening 46 in FIG. 5) and receives a nut 64'. The nuts 64' are used to secure the device to an instrument rack or other suitable support as explained above.

Figure 8:
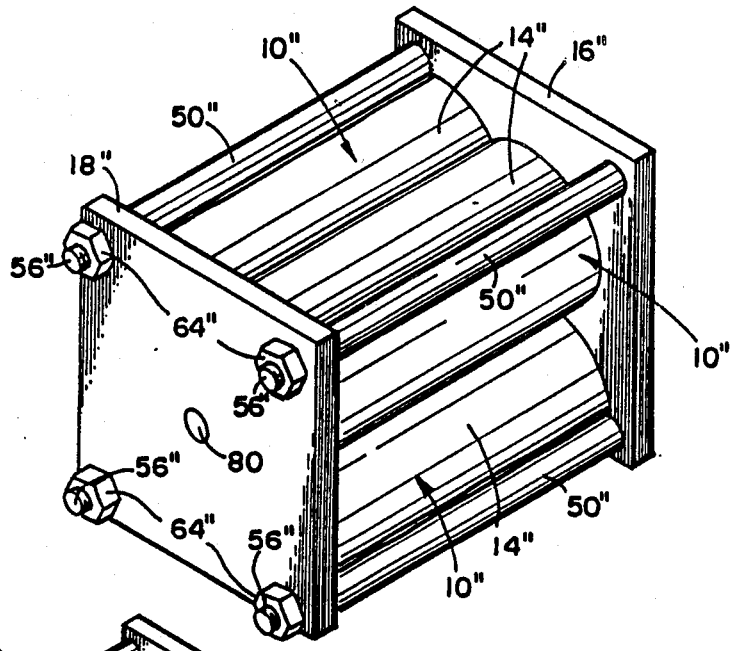
FIG. 8 is a perspective view of a plurality of filters arranged in a different array than in FIG. 7.

Referring to FIG. 8, a further embodiment of the invention is illustrated.

In this embodiment of the invention those elements which correspond to the elements shown in the embodiment illustrated in FIGS. 1–6 will be identified by the same numbers followed by a double prime ("), it being understood that the elements have the same structure.

Thus, in FIG. 8 generally rectangular end plates such as the square end plates 16" and 18" are provided. The end plates are provided with facing annular grooves (not shown) which are arranged in a rectangular array so that a plurality of band pass-band reject filters 10" each including an annular wall 14" can be supported between them. Elongated bolts 50" which are identical in structure to bolts 50 described earlier are connected between the end plates 16" and 18" and serve to rigidly support the end plates and annular walls 14" and at the same time to provide a means for connecting the structure to an instrument rack.

As explained earlier, the bolt heads are soldered to the end plates 16" and are soldered to the sides of the annular walls 14" along their length. However, in the embodiment of the invention shown in FIG. 8 central bolt 80 is not connected to any of the walls 14".

The embodiment of the invention shown in FIG. 8 is connected to an instrument rack or other support by nuts 64" which are threaded over the threaded end portions 56" of the bolts 50".

Thus, what has been described is a structure defining a housing for supporting an individual or plurality of band pass-band reject filters in a manner which enables them to be assembled and adjusted and then sealed to reduce the likelihood of damage in transit or in subsequent use.

Thus, while the invention is being described with respect to certain embodiments thereof, it is apparent that other forms and embodiments will be obvious to those skilled in this art. Thus, the scope of the invention should not be limited by this foregoing description, but rather, only by the scope of the claims appended hereto.

Although the bolts 50 are preferably used, other equivalent connecting means performing the same function may be substituted.

I claim:

1. A band pass-band reject filter comprising at least one cylindrical housing, a first end plate at one end of said housing and a second end plate at another end of said housing, a plurality of bolts extending from one end plate to the other and being spaced from each other around an outer periphery of said housing, said bolts being rigidly connected to said first end plate and to the peripheral surface of said housing, and being detachably connected to said second end plate, whereby said housing and said first end plate may be detached as a unit from said second end plate, and a tuning rod threadedly secured in an aperture in said first end plate and axially movable within said housing along a direction parallel with said bolts.

2. A filter as defined in claim 1 including means defining a groove on each of said end plates, and the ends of said cylinder being received in said grooves.

3. A filter as defined in claim 1 wherein each of said bolts has a first portion having a cross section of predetermined dimension and a second portion having a reduced cross section, and the juncture of said first and second cross sections defining a ledge.

4. A filter as defined in claim 3 wherein said first end plate includes a plurality of holes for receiving said first portions of corresponding bolts, said second end plate including a plurality of holes for receiving said second portions of said bolts whereby said second end plate lies against said ledge so that said second end plate is restrained against moving relative to said bolts.

5. A filter as defined in claim 1 wherein one of said end plates includes means for connecting said filter to an electrical circuit.

6. A filter as defined in claim 1 wherein said housing is soldered to said bolts and to said first end plate.

7. A filter as defined in claim 1 including a plurality of housings disposed between said end plates, each of said housings containing a band-pass band-reject filter, means on one of said end plates for connecting at least some of said filters to each other, and means on one of said end plates for tuning said filters.

8. A filter as defined in claim 7 wherein said end plates are rectangular and said filters are laterally disposed in side-by-side relation in a single plane.

9. A filter as defined in claim 7 wherein said end plates are rectangular, and said filters are laterally disposed to each other in a plurality of planes, each plane being lateral to the other planes.

10. A filter as defined in claim 1 wherein said end plates are comprised of a material selected from the group consisting of solid copper, steel with copper plating and steel with silver plating.

11. A filter as defined in claim 1 wherein said bolts are comprised of a material selected from the group consisting of copper, copper plated steel and silver plated steel.

* * * * *